US007912620B2

(12) United States Patent
French et al.

(10) Patent No.: US 7,912,620 B2
(45) Date of Patent: Mar. 22, 2011

(54) TURBOCHARGED INTERNAL COMBUSTION ENGINE

(75) Inventors: Pierre Bernard French, Holmfirth (GB); Mark R. Firth, Halifax (GB); Dean H. Reichenbach, Columbus, IN (US)

(73) Assignee: Cummins Turbo Technologies Limited, Huddersfield (GB)

( * ) Notice: Subject to any disclaimer, the term of this patent is extended or adjusted under 35 U.S.C. 154(b) by 0 days.

(21) Appl. No.: 12/573,291

(22) Filed: Oct. 5, 2009

(65) Prior Publication Data

US 2010/0114454 A1 May 6, 2010

Related U.S. Application Data

(63) Continuation of application No. PCT/GB2008/001082, filed on Mar. 31, 2008.

(30) Foreign Application Priority Data

| | | |
|---|---|---|
| Apr. 10, 2007 | (GB) | 0706913.1 |
| May 10, 2007 | (GB) | 0708974.1 |
| Jun. 27, 2007 | (GB) | 0712452.2 |

(51) Int. Cl.
*F02D 43/00* (2006.01)
*F01M 11/10* (2006.01)

(52) U.S. Cl. ..... 701/102; 123/196 S

(58) Field of Classification Search ..... 701/101, 701/102, 115; 123/196 S; 184/6.4, 6.11
See application file for complete search history.

(56) References Cited

U.S. PATENT DOCUMENTS

| | | | | |
|---|---|---|---|---|
| 4,499,733 | A | 2/1985 | Farr et al. | |
| 4,953,110 | A * | 8/1990 | Chartrand | 701/101 |
| 5,079,921 | A * | 1/1992 | McCandless et al. | 60/602 |
| 2009/0107770 | A1 * | 4/2009 | Mischler et al. | 184/6.4 |

FOREIGN PATENT DOCUMENTS

| | | | |
|---|---|---|---|
| FR | 2 684 744 | A | 6/1993 |
| GB | 2 266 612 | A | 11/1993 |
| JP | 59141724 | A | 2/1983 |
| JP | 60 138229 | A | 7/1985 |
| JP | 61 123719 | A | 6/1986 |
| JP | 01080720 | A | 3/1989 |
| JP | 4-183932 | A * | 6/1992 |
| JP | 05 321687 | A | 12/1993 |
| JP | 2005 009434 | A | 1/2005 |

OTHER PUBLICATIONS

International Search Report and Written Opinion, PCT/GB2008/001082, Cummins Turbo Technologies Limited, Aug. 19, 2008.
United Kingdom Search Report, GB 0706913.1, Cummins Turbo Technologies Limited, Jul. 24, 2007.

* cited by examiner

*Primary Examiner* — Hieu T Vo
(74) *Attorney, Agent, or Firm* — Krieg DeVault LLP; J. Bruce Schelkopf, Esq.

(57) ABSTRACT

A control system for controlling the supply of oil to a turbocharger fitted to an internal combustion comprises an oil supply valve (21) controlled by a controller (20) and at least one sensor (23-28) for monitoring a parameter associated with the existence or potential occurrence of a leak in the turbocharger oil supply, or of a condition potentially resulting in such a leak. The controller (20) is operable to determine the existence or possible occurrence of an oil leak in the turbocharger oil supply in response to a signal received from the sensor (23-28) and to close the oil supply control valve (21) in the event of said determination to cut off the oil supply to the turbocharger.

20 Claims, 2 Drawing Sheets

TURBOCHARGED INTERNAL COMBUSTION ENGINE

CROSS REFERENCE TO RELATED APPLICATIONS

The present application is a continuation of PCT/GB2008/001082 filed on Mar. 31, 2008, which claims priority to United Kingdom Application No. 0712452.2 filed Jun. 27, 2007, United Kingdom Patent Application No. 0708974.1 filed May 10, 2007 and United Kingdom Patent Application No. 0706913.1 filed Apr. 10, 2007, each of which is incorporated herein by reference.

The present invention relates to a turbocharged internal combustion engine, such as a diesel engine. More particularly, the invention relates to a system for controlling the oil supply to a turbocharger in a turbocharged combustion engine.

Turbochargers are well known devices for supplying air to the intake of an internal combustion engine at pressures above atmospheric pressure (boost pressures). A conventional turbocharger essentially comprises an exhaust gas driven turbine wheel mounted on a rotatable shaft within a turbine housing connected downstream of an engine exhaust gas manifold. Rotation of the turbine wheel rotates a compressor wheel mounted on the other end of the shaft within a compressor housing. The compressor wheel delivers compressed air to the engine intake manifold. The turbocharger shaft is conventionally supported by journal and thrust bearings, including appropriate lubricating systems, located within a central bearing housing connected between the turbine and the compressor wheel housing. The lubricating system typically includes an oil supply line for supplying lubricating oil to the bearing housing from the oil galleries of the engine oil supply system.

Turbochargers operate in a very hot environment. Not only is a turbocharger inherently a hot device (since it passes hot exhaust gases) it is also generally located on or adjacent the engine exhaust manifold. As such, turbochargers operate in an environment in which there is risk of fire in the event of oil leaking from the turbocharger or turbocharger oil supply line. In addition to the possibility of an engine bay fire, fires internal to the exhaust ducting can also take place, particularly if the engine continues in use whilst oil is leaking into the exhaust duct. Such internal fires can cause serious consequential damage in or around the engine installation.

Systems are therefore known for controlling operation of a turbocharger in a potentially hazardous situation. For instance, U.S. Pat. No. 4,953,110 discloses a system for monitoring various operating conditions of a turbocharger and for controlling the air flow to the turbocharger when monitored operating conditions meet or exceed predetermined limits. For instance sensors may be provided to monitor such parameters as the pressure of the intake air to the engine, the temperature of the exhaust gases produced by the engine, the rotational speed of the turbocharger, and oil pressure of the turbocharger. The sensors provide measurement signals to a control processor, which is operable to control operation of a vane assembly located in the air inlet of the turbocharger to reduce or completely shut off air supply to the turbocharger in the event of a monitored conditions such as excessive pressure of the intake air, overheating of the exhaust gas, over speeding of the turbocharger, or detection of a fire in the exhaust manifold. Reducing air supply to the turbocharger has the consequential effect of throttling back the engine. If necessary, if the circumstances warrant it, the air supply can be shut off completely in order to completely starve the engine of combustion air so that the engine itself will cease operation. However this has the effect of stalling the engine which could be highly undesirable for instance in a truck environment where some residual power may be required for maneuvering the truck to a safe location out of traffic.

As well as controlling operation of the engine, shutting off air supply to the turbocharger prevents potentially harmful products of a fire from entering the exhaust gas stream from where they may subsequently be released into the atmosphere.

Another example of a turbocharger control system which operates to shut down supply of air to a turbocharger in the event of detection of a fire is disclosed in U.S. Pat. No. 4,499,733. This discloses an emergency shutdown mechanism for a turbocharged diesel locomotive engine to prevent over speeding of a turbocharger under engine malfunction conditions. The shut down mechanism includes an air flow shut off plate for selectively closing the air intake of the turbocharger as a result of detection of an increase in temperature and/or pressure indicative of a fire in the engine air box. Again, shutting the air flow to the turbocharger results in the engine being starved of combustion gas so that the engine itself will shut down and over speeding of the turbocharger prevented.

Known control systems which operate to shut off air supply to the turbocharger in the event of hazardous or potentially hazardous situation have several limitations. For instance, shutting off air supply to the turbocharger to shut down the turbocharger engine may not be sufficient to prevent an engine compartment fire resulting from leakage of oil from the turbocharger if the turbocharger has suffered a catastrophic failure, or as the result of an impact in the event of an accident.

It is an object of the present invention to provide a control system for a turbocharged internal combustion engine which obviates or mitigates the above limitation.

An embodiment of the present invention will now be described, by way of example only, with reference to the accompanying drawings in which.

Figure 1:
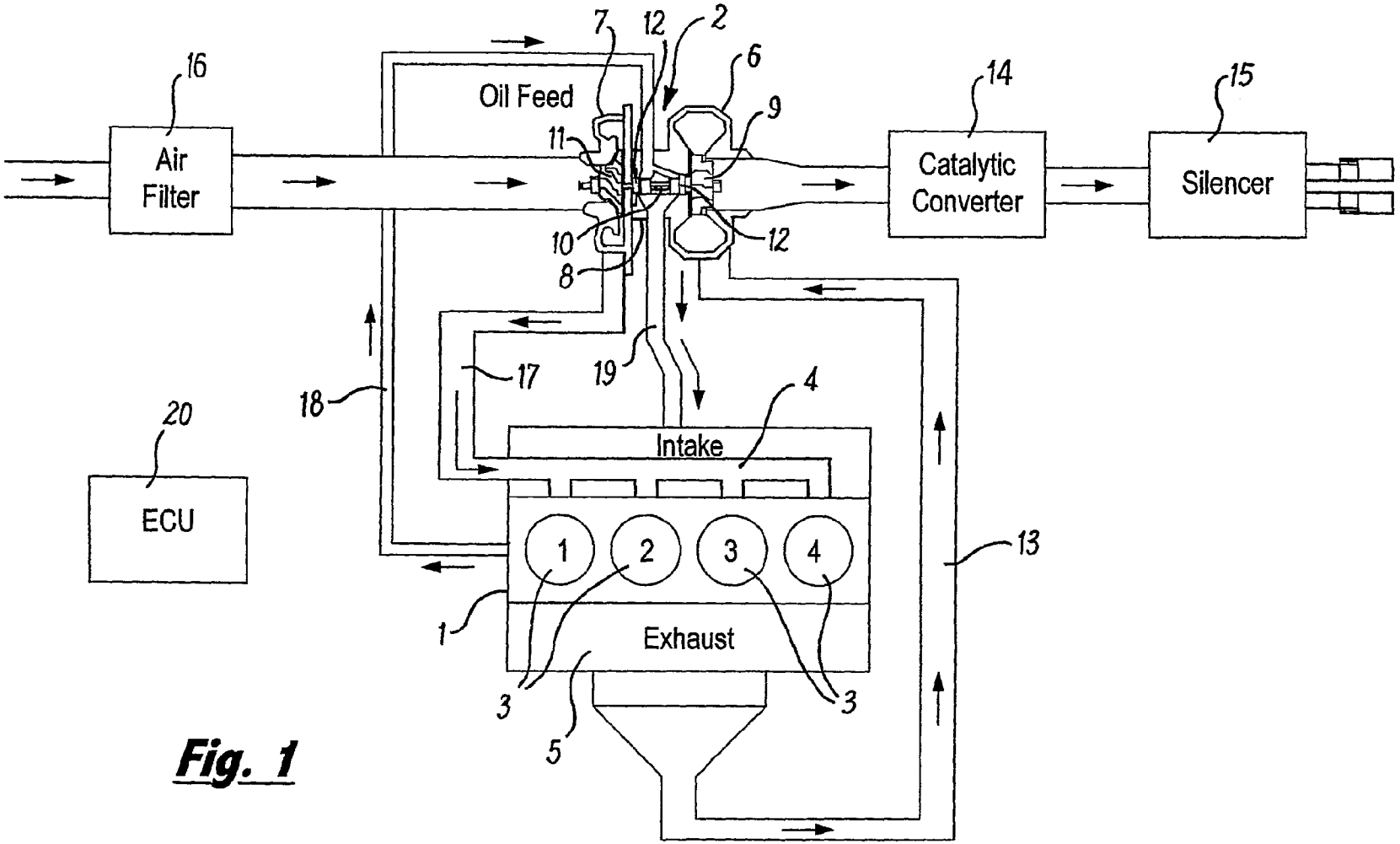
FIG. 1 is a schematic illustration of a turbocharged engine.

Referring to the FIG. 1, there is schematically illustrated an internal combustion engine (such as a diesel engine) 1 fitted with a turbocharger 2. The engine 1 comprises engine cylinders 3 which receive combustion air via an intake manifold 4 and discharge exhaust gas via an exhaust manifold 5.

The turbocharger 2 comprises a turbine housing 6 connected to a compressor housing 7 via a central bearing housing 8. A turbine wheel 9 rotates on one end of a turbocharger shaft 10 within the turbine housing 6. A compressor wheel 11 is mounted to the opposite end of the turbocharger shaft 10 within the compressor housing. The turbocharger shaft passes through the central bearing housing and rotates on bearing assemblies 12.

Exhaust gas from the engine exhaust manifold 5 flows to the turbocharger turbine housing via exhaust gas line 13. The exhaust gas rotates the turbine wheel 9 as it flows through the turbine housing 6, and then exits via a conventional exhaust system including a catalytic converter 14 and a silencer 15 before being released to atmosphere. Rotation of a turbine wheel 9 rotates the compressor wheel 11 which is mounted to the opposite end of the turbocharger shaft 10. The compressor draws in combustion air via an air filter 16 and provides a compressed air flow to the engine intake manifold via intake air line 17.

An oil supply is circulated through the bearing housing 8 to lubricate the turbocharger bearings (12) via an oil supply line 18 and an oil drain line 19 which circulate oil from the engine oil galleries. Seal assemblies (not shown in detail) are mounted within the bearing housing at both the compressor end and the turbine end of the shaft 10 in order to prevent oil leakage into the compressor and turbine housings, which in turn prevents oil entering either the intake air supply 17 or the exhaust gas flow 13.

Operation of the engine and turbocharger is controlled via an engine control unit (ECU) shown schematically as box 20. As is well known in the art, the ECU controls numerous aspects of operation of the engine 1 and turbocharger 2, and can also control other related functions such as transmission operation. For instance, an ECU will typically determine the quantity of fuel for supply to the engine 1, ignition timing and the level of turbocharger boost pressure. In addition feedback control is provided via sensors (not shown in FIG. 1) placed around the engine to monitor relevant parameters. These can include MAP sensors, temperature sensors, throttle and other moving component position sensors, engine coolant temperature sensors, oil pressure sensors etc. Many ECU's will also include diagnostic functionality, determining the onset or existence of operational problems through signals provided by such sensors. In the schematic illustration of FIG. 1 no attempt has been made to illustrate the connection of the ECU to various sensors or elements of the engine/turbocharger.

Figure 2:
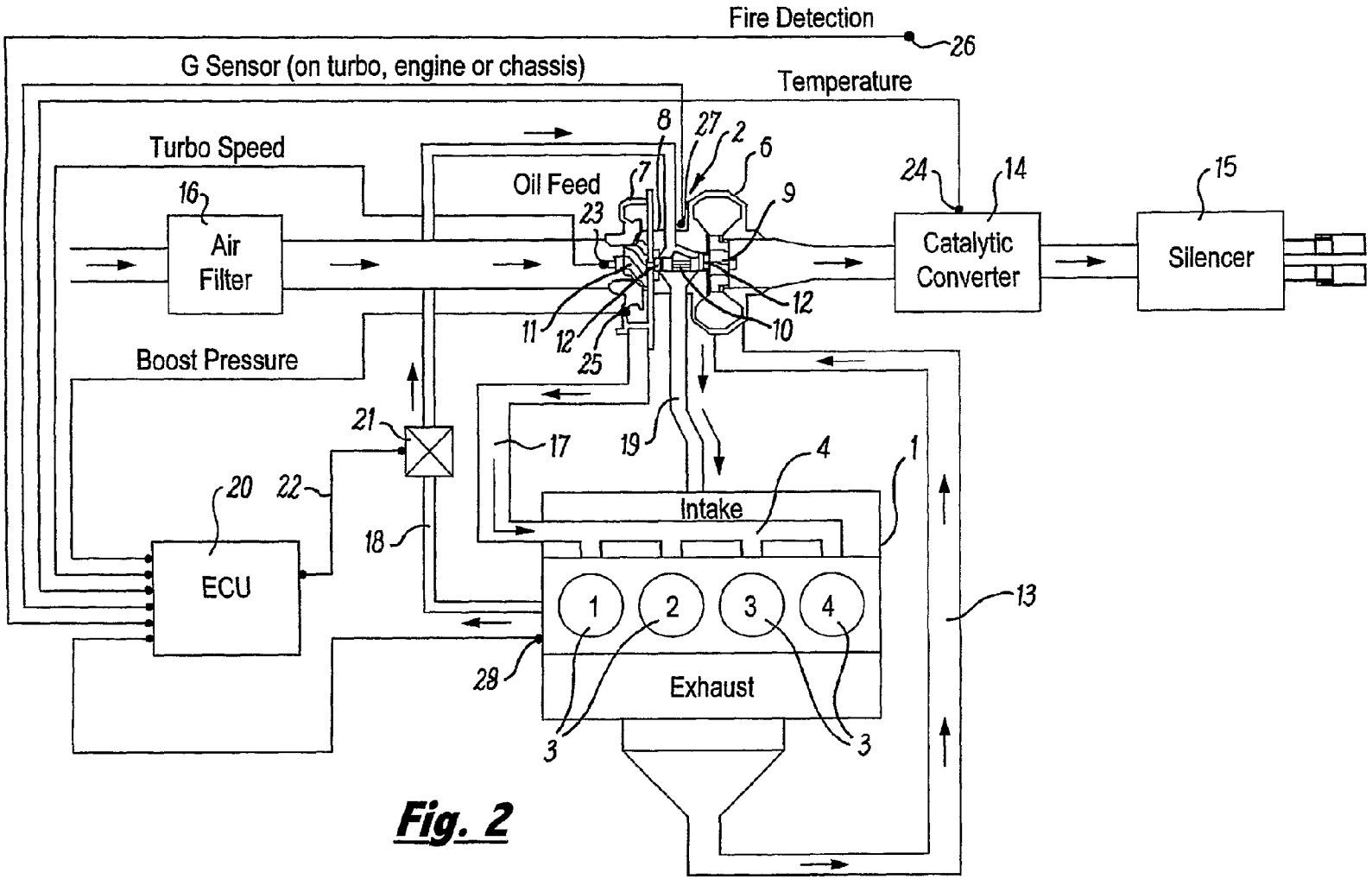
FIG. 2 is a schematic illustration of the turbocharged engine of FIG. 1 provided with a control system according to the present invention.

Referring now to FIG. 2, this is a schematic illustration corresponding to the illustration of FIG. 1, but modified in accordance with the present invention.

Referring to FIG. 2, in accordance with the present invention an oil supply control valve 21 is provided in the oil supply line 18 to the turbocharger 2. Operation of the valve 21 is controlled by the ECU 20 via signal path 22.

In accordance with the present invention, the ECU 20 is programmed to determine the existence, or possible occurrence, of a serious turbocharger failure condition (such as catastrophic failure of the turbocharger) which may for instance lead to oil leakage from the turbocharger bearing housing 8. The main oil leakage problems are a possibility of a leakage from the bearing housing 8 into the compressor housing 7 leading to oil ingestion by the engine 1; the possibility of oil leakage from the bearing housing 8 into the turbine housing 6 leading to oil in the exhaust system; the possibility of oil supply or drain lines 18, 19 leaking so that oil leaks into the engine compartment; and the possibility of spraying of oil from the turbocharger 2 into the engine compartment as a result of rupturing of the turbocharger following a catastrophic failure, such as disintegration of the housing compressor 7 following extreme over speeding of the turbocharger, or damage due to impact. Oil leaking into the exhaust system can lead to internal fires in the exhaust manifold for example and can also contaminate downstream emissions equipment. Although less common, oil leaking into the air induction system can be ignited in the combustion process, effectively providing an uncontrolled fuel supply causing engine overspeed and preventing engine shut down.

Leakage in the oil supply to the turbocharger can be a particular problem because the oil supply line 18 to a turbocharger is generally the only high-pressure oil line external to the engine. In particular, in some circumstances the turbocharger may fail, or the oil supply line may rupture, but the engine may continue to run so that for instance oil is effectively sprayed onto hot parts of the engine resulting in a fire in the engine compartment.

In accordance with the present invention the ECU determines the existence, or possibility, of such a condition by measurement of various engine parameters from conventional sensors disposed around the engine/turbocharger, or from dedicated sensors added to the engine/turbocharger in accordance with the present invention. The existence, or possible occurrence, of a potentially hazardous situation can for instance be determined by comparing measured values with pre-determined stored values, or otherwise interpreted from the measured values, in response to which the ECU (under appropriate programming) can operate to control the oil supply valve 21 to reduce, or completely shut-off oil supply to the turbocharger. In this way, the potential for a fire resulting from oil leakage from the turbocharger oil supply can be greatly reduced or completely eliminated. Similarly, potentially expensive damage to downstream emissions equipment can be avoided since equipment such as particulate filters and selective catalytic reducers can be rendered useless by oil contamination.

In FIG. 2 a number of possible sensors are illustrated as follows:

A turbocharger speed sensor 23 is provided to monitor the rotational speed of the turbocharger. The ECU 20 may be programmed to close the oil supply valve 21 in response to the monitored turbocharger speed reaching or exceeding a predetermined limit indicative of over speeding which could result in catastrophic failure. The ECU may be programmed to close the oil supply valve if the monitored turbocharger speed drops unexpectedly, or drops to zero, which may indicate turbocharger failure. Similarly, the oil supply could be stopped if the speed senor fails to transmit any data at all which would be another indicator of likely turbocharger failure.

A temperature sensor 24 is provided at the catalytic converter 14 to monitor the temperature of the exhaust gas. The ECU 20 could be programmed to close the oil supply valve 21 in the event that the monitored temperature reaches or exceeds a predetermined temperature indicative of, for instance, a fire in the exhaust manifold or other problem possibly leading to overheating of the turbocharger 2 with a resultant likelihood of failure and oil leakage problems.

A boost pressure sensor 25 is provided to monitor the boost pressure produced by the turbocharger compressor 7/11. Again, the ECU 20 can be programmed to shut the oil supply valve 21 if the monitored boost pressure reaches or exceeds a predetermined limit or drops below a predetermined limit indicating the likelihood of failure or failure of the compressor and rupturing of the compressor and/or bearing housing.

A fire detection sensor 26 is provided to determine the existence of a fire in the engine compartment in response to which the ECU 20 can be programmed to close the oil supply valve 21.

An acceleration sensor 27 (G sensor) is provided (e.g. on the turbocharger or chassis) to detect extreme acceleration as might be encountered in a collision or catastrophic failure of the turbocharger such as a wheel burst, and the ECU 20 could be programmed to close the oil supply valve 21 on detection of such an acceleration condition.

An engine crankcase pressure sensor 28 is provided to monitor the crankcase pressure and the ECU could be programmed to close the oil supply valve 21 if the monitored pressure reaches or exceeds a determined value (for instance of the order of about 150 millibars). Crankcase pressure is normally relatively low—typically of no more than about 20 millibars. Existence of an abnormally high crankcase pressure can indicate a serious engine or turbocharger fault which may lead to oil leakage. For example if an engine piston scuffs badly, or a cylinder valve stem fails, large quantities of blowby gases can enter the crankcase increasing crankcase pressure (a crankcase ventilation valve provided to control crankcase pressure is unlikely to be able to handle such a sudden large increase in blowby gas flow). Similarly crankcase pressure would rise if the crankcase ventilation valve fails or if turbocharger shaft seals fail leading to increased blowby. Increased crankcase pressure can force oil from the turbocharger bearing housing into the inlet manifold to be ingested by the engine, or into the exhaust system.

It will be appreciated that the illustrated sensors 23-28 are examples only, and that more or less sensors may be included in a turbocharger control system according to the present invention. It will also be appreciated that the turbocharger control system may operate the valve 21 in accordance with determinations made by the ECU 20 on the basis of signals received from conventional sensors which will typically be included in an engine management system.

It will also be appreciated that the ECU may close the valve on the basis of signals from a single sensor or on the basis of a combination of signals from a plurality of sensors meeting a particular condition. For example, the ECU could be programmed to close the oil supply valve when both turbocharger speed and boost pressures drop to zero indicating a serious turbocharger problem, but not to close simply because only one of these values drops to zero.

It will thus be appreciated, that in accordance with the present invention upon the detection of a condition likely to result in oil leakage from the turbocharger or turbocharger oil supply lines, or detection of the possibility of the occurrence of such a condition, the oil supply to the turbocharger can be stopped thus greatly reducing the amount of oil that can possibly leak from the turbocharger into the intake air, the exhaust gas, or the engine compartment thereby greatly reducing the risk of problems arising from such leakage.

The ECU 20 may be additionally programmed that a predetermined period after closure of the oil supply valve 21, the air supply to the turbocharger, or exhaust path from the turbocharger, may be shut off to prevent air/exhaust gas flow through the turbocharger and thus shut down the turbocharger thereby starving the engine of combustion air so that the engine also shuts down. Thus will further stifle the potential for fire in or around the engine compartment. It is, however, an advantage of the present invention that the engine may be allowed to continue to run for a short period of time following closure of the oil supply valve 21 since during this period potential dangers due to oil leakage are greatly reduced. This can be an advantage for instance where the engine is fitted to a road vehicle as it will allow time for the vehicle to be safely removed from traffic, which would not be possible if the turbocharger/engine is shut down immediately upon detection of a failure or other hazardous condition.

The oil supply control valve may be a "one-shot" valve which may not be re-opened without intervention of a service mechanic so that operation of the engine/turbocharger is prevented until the system has been properly investigated and any necessary repairs made. For instance, the oil supply valve may include an actuator comprising an explosive device similar to the type of explosive device conventionally used in vehicle seatbelt or airbag systems.

The present invention has advantages over the prior art mentioned above in that it is able to greatly reduce the possibility of fire due to oil leakage, or the possibility of oil entering the engine air intake or exhaust gas flow, without the need to immediately shut down the turbocharger and engine. In addition, the present invention greatly reduces the potential problems of an oil leak in the event of a sudden catastrophic turbocharger failure leading for instance to rupturing of the bearing housing (for example through impact) or the oil supply or drain line under which circumstances shutting off the air supply to the turbocharger (in accordance with the prior art) would not prevent oil leakage and the problems associated with that leakage.

As mentioned above, it will be appreciated that the sensors illustrated in FIG. 2 are examples only of appropriate sensors that may be included in the system according to the present invention. The illustrated sensors are of a type that may typically included with any engine management system and are not necessarily sensors dedicated to the control of the oil supply valve 21. It is an advantage of the present invention that the information required by the ECU for control of the oil supply valve 21 may be obtained from existing sensors. However, it is also contemplated that dedicated sensors may be provided for the oil supply control system of the present invention.

Examples of other sensors that may be incorporated in a system according to the present invention include an accelerometer on or adjacent to the turbocharger shaft to detect turbo shaft failure, for instance gross out of balance conditions, rubbing or burst conditions, so that the oil supply valve can be closed in response to detection of such a condition.

The ECU 20 could also be programmed to control the oil supply valve 21 in response to activation of seatbelt or airbag explosive devices etc, i.e. to close the oil supply valve in response to detection of actuation of such existing safety devices.

In the above described embodiment of the invention the oil supply valve 21 is shown located in the oil supply pipe from the engine to the turbocharger. It will be appreciated that the precise location of the oil supply valve may vary from that described. In particular, the oil supply valve may be located upstream of the oil supply pipe so that when the oil supply valve is closed there is no possibility of oil leaking from the oil supply pipe if this is ruptured. For instance, the oil supply valve could be mounted to an appropriate part of the engine, such as on the oil filtration head from which cooled and/or filtered oil is delivered to the turbocharger. Alternatively, the oil supply valve could be mounted on the engine oil filter.

The oil supply valve may take a variety of conventional forms, including butterfly valves, flap valves, rotary valves, ball valves, sliding plate valves etc. Although it is preferred that the oil supply control system according to the present invention is controlled by the ECU, a separate controller could be provided. That controller could receive a signal from the ECU, or could directly receive the same control signals provided to the ECU by sensors around the engine, or control signals from a subset of those sensors, or may receive control signals from sensors dedicated to the oil supply control system and independent from other engine management functions.

In so far as the ECU or other controller may also be operable to shut down operation of the turbocharger and/or engine subsequent to closure of the oil supply valve (which may be after a predetermined time—for instance several minutes), that operation may be entirely conventional. That is, a conventional exhaust brake valve could for instance be controlled to close the exhaust path from the turbine, a conventional inlet arrangement as for instance shown in the prior art documents mentioned above could be used to shut off air supply to the turbocharger in appropriate circumstances, and for instance fuel supply to the engine could be cut off in accordance with known systems. Details of such systems will be available to the skilled person and therefore will not be described here. The oil supply control system in accordance with the present invention could for instance be incorporated in known turbocharger control systems as for instance disclosed in the prior art patents mentioned above.

The invention claimed is:

1. A control system for controlling the supply of oil to a turbocharger fitted to an internal combustion engine, the system comprising:

a controller;

an oil supply valve controlled by said controller; and at least one sensor for monitoring a parameter associated with the existence or potential occurrence of a leak in the turbocharger oil supply, or of a condition potentially resulting in such a leak; wherein the controller is operable to determine the existence or possible occurrence of an oil leak in the turbocharger oil supply, or of a condition potentially resulting in such an oil leak, in response to a signal received from said sensor and to close the oil supply control valve in the event of said determination thereby shutting off the oil supply to the turbocharger.

2. A control system according to claim 1, comprising a plurality of said sensors.

3. A control system according to claim 2, wherein the or each sensor comprises one or more of the following sensors:

a turbocharger speed sensor;

a temperature sensor;

a turbocharger boost pressure sensor;

a fire detection sensor;

an acceleration sensor;

an oil supply pressure sensor;

a shock sensor;

an engine crankcase pressure sensor:

a sensor linked to a safety system of the engine and/or turbocharger and/or a vehicle to which the engine/turbocharger is fitted.

4. A control system according to claim 2, wherein the turbocharged internal combustion engine is fitted to a vehicle, and the or each sensor monitors an operating parameter of the vehicle, or of a safety system of the vehicle, and the controller makes the determination on the basis of said parameter.

5. A control system according to claim 2, wherein the controller is an ECU provided for monitoring and controlling operation of various engine and/or turbocharger operating parameters.

6. A control system according to claim 1, wherein the or each sensor monitors an operating parameter of the engine and/or turbocharger, and wherein said controller makes said determination from comparison of the monitored value of the parameter to a predetermined value of the parameter.

7. A control system according to claim 1, wherein the turbocharged internal combustion engine is fitted to a vehicle, and the or each sensor monitors an operating parameter of the vehicle, or of a safety system of the vehicle, and the controller makes the determination on the basis of said parameter.

8. A control system according to claim 1, wherein the controller is an ECU provided for monitoring and controlling operation of various engine and/or turbocharger operating parameters.

9. A control system according to claim 1, where oil is supplied to the turbocharger via an oil supply line, and wherein said oil supply valve controls the flow of oil through said oil supply line.

10. A control system according to claim 9, wherein said oil supply line is connected to an oil gallery or chamber of the engine.

11. A control system according to claim 10, wherein said oil supply valve is mounted to said engine.

12. A control system according to claim 10, wherein said engine is provided with an oil filter and said oil supply valve is mounted to said oil filter.

13. A control system according to claim 9, wherein the oil supply valve is located in said oil supply line.

14. A control system according to claim 9, wherein said oil supply valve is located upstream of said oil supply line.

15. A control system according to claim 1, wherein the or each sensor comprises one or more of the following sensors:

a turbocharger speed sensor;

a temperature sensor;

a turbocharger boost pressure sensor;

a fire detection sensor;

an acceleration sensor;

an oil supply pressure sensor;

a shock sensor;

an engine crankcase pressure sensor;

a sensor linked to a safety system of the engine and/or turbocharger and/or a vehicle to which the engine/turbocharger is fitted.

16. A method for controlling the supply of oil to a turbocharger fitted to an internal combustion engine, the method comprising shutting off oil supply to the turbocharger in the event of determination of the existence or possible occurrence of an oil leak in the turbocharger oil supply, or of a condition potentially resulting in such an oil leak.

17. A method according to claim 16, wherein said determination is made by a controller responsive to a signal received from at least one sensor monitoring a parameter associated with the existence or potential occurrence of a leak in the turbocharger oil supply, or of a condition potentially resulting in such a leak.

18. A method according to claim 17, wherein oil supply to the turbocharger is shut off by closing an oil supply control valve provided in or upstream of an oil supply line to the turbocharger.

19. A method according to claim 16, wherein oil supply to the turbocharger is shut off by closing an oil supply control valve provided in or upstream of an oil supply line to the turbocharger.

20. A method according to claim 16 for controlling the oil supply to a turbocharger of an internal combustion engine fitted to a vehicle, wherein oil supply to the turbocharger is shut off in response to activation of a vehicle emergency safety system.

* * * * *